United States Patent [19]

Brown

[11] 4,085,465

[45] Apr. 25, 1978

[54] SHOULDER STRAP GUARD

[76] Inventor: Clifford K. Brown, 5913 London Rd., Duluth, Minn. 55804

[21] Appl. No.: 764,160

[22] Filed: Jan. 31, 1977

[51] Int. Cl.[2] ..... A41D 27/22

[52] U.S. Cl. ..... 2/271; 24/85 R

[58] Field of Search ..... 2/271; 24/85 R, 86 R, 24/87 R, 73 LF, 73 GS, 86 B, 259 A, 182

[56] References Cited

U.S. PATENT DOCUMENTS

| | | | |
|---|---|---|---|
| 1,949,331 | 2/1934 | Richardson | 24/73 GS |
| 2,932,869 | 4/1960 | Neubig | 24/85 R |

FOREIGN PATENT DOCUMENTS

| | | | |
|---|---|---|---|
| 491,081 | 8/1938 | United Kingdom | 24/86 R |

*Primary Examiner*—Doris L. Troutman
*Attorney, Agent, or Firm*—Stuart R. Peterson

[57] ABSTRACT

A shoulder strap guard in the form of a one-piece wire includes rearwardly projecting prong portions and forwardly projecting tongue portions, the tongue portions being maintained in a vertically spaced plane above the plane of the prong portions by inwardly and upwardly curving intermediate or connecting portions. A bead loosely encircles a transverse portion connecting the forwardly projecting ends of the tongue portions together so that after the prong portions have been inserted into the shoulder section of an outer garment, the shoulder strap of a handbag or the like can slide past the bead into a position underlying the tongue portions.

5 Claims, 9 Drawing Figures

SHOULDER STRAP GUARD

BACKGROUND OF THE INVENTION

This invention relates to a guard for preventing undue slippage of the shoulder strap of a handbag or the like.

Various arrangements have been devised for retaining shoulder straps on a person's shoulder. In this regard, various types of bags and cases utilize shoulder straps that are placed over the user's shoulder to facilitate carrying of the bag. Owing to the natural slope or slant of people's shoulders, there is a constant tendency for the strap to slide off the shoulder which can be quite annoying.

The prior art devices with which I am familiar are intended to engage or receive the shoulder strap from the outset rather than after a limited amount of shifting has occurred. Such devices require the user to perform an awkward manipulation in engaging the strap. While the devices with which I am acquainted are generally satisfactory, there are still other shortcomings, besides having to physically place the strap in engagement, that have militated against any extensive use of devices of this character.

SUMMARY OF THE INVENTION

A general object of my invention is to provide a guard for a shoulder strap to be placed over a person's shoulder in the usual way and without any thought as to its location, yet assuring that the shoulder strap will not slide completely off the user's shoulder.

Another object of the invention is to provide a shoulder strap guard that can be attached to an outer garment at any preferred location thereon, thereby enabling the guard to be placed where it limits strap slippage to whatever extent is desired but in any event preventing complete slippage of the strap from the wearer's shoulder.

Another object is to provide a shoulder strap guard that can be readily attached and removed while the user is wearing the garment, yet which will be firmly anchored once it has been attached. Also, the invention has for an aim the automatic limiting of the degree of prong penetration, so that the user need not be concerned with either too much or too little anchorage of the prongs.

A further object of the invention is to provide a shoulder strap guard that will not damage the garment even though it is attached and removed many times.

Yet another object is to provide a wire guard that will not rock and which will be relatively stable when attached to clothing. More specifically, an aim of the invention is to impart a greater lateral spacing to the prong elements, which engage the garment, than the tongue elements, which engage the shoulder strap after the strap has shifted sufficiently.

Still further, another object is to provide a shoulder strap guard that will be quite inconspicuous, yet to the extent it can be noticed it will be aesthetically attractive in appearance.

Another object is to provide a shoulder strap guard that can be fabricated inexpensively, thereby encouraging its widespread use. In this regard, an aim of the invention is to provide a shoulder strap guard that can be manufactured at such little cost that users will be induced to acquire one for each outer garment they own. It is also within the purview of the invention to produce shoulder strap guards of the foregoing type at such a low cost that they can be used as promotional and premium items, particularly in that they are lightweight, compact and readily mailed.

Briefly, my invention includes a single length of wire that is bent into a configuration so that there are rearwardly projecting prongs having points thereon such that the prongs are readily inserted into various garment materials. Forwardly projecting tongue portions provide a recess or gap for the accommodation of the shoulder strap when it shifts sufficiently from the location in which it is initially draped over a person's shoulder. The prong portions are spaced laterally in one plane farther apart than are the tongue portions which reside in a second or raised plane, thereby imparting stability to the guard when it is attached to a person's garment.

DESCRIPTION OF THE PREFERRED EMBODIMENT

Figure 1:
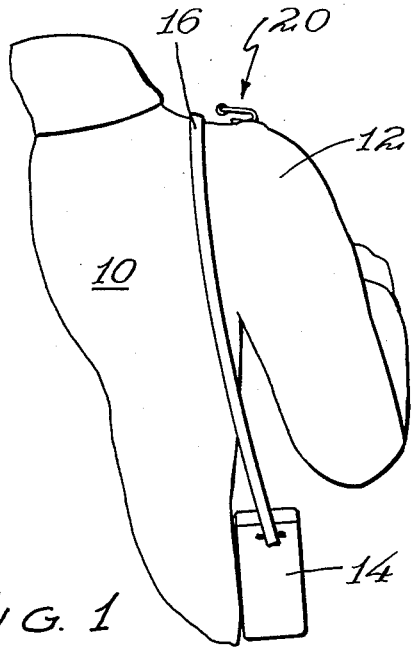
FIG. 1 is a fragmentarily presented rear view of a person utilizing my shoulder strap guard, the shoulder strap appearing in its normal or unshifted position.

In order to appreciate more fully the benefits to be derived from a practicing of my invention, an outer garment in the form of a coat 10 has been fragmentarily pictured in FIGS. 1–4. Inasmuch as the invention concerns only the wearer's shoulder, the shoulder portion of the garment 10 has been labeled 12. Still further, a carrying bag 14 has been depicted, having the usual shoulder strap 16. While the carrying bag 14 will normally be a woman's handbag, nonetheless it will be appreciated that the bag 14 can constitute various types of bags or cases, a camera case being but one additional type of item utilizing a shoulder strap.

A one-piece wire guard exemplifying my invention has been denoted in its entirety by the reference numeral 20. While the wire stock can vary in diameter, it is planned that the wire forming the guard 20 be fabricated from No. 18 gauge wire, this gauge having a diameter of 0.040 inch. The guard 20, if desired, can be coated with an appropriately colored enamel.

Figure 7:
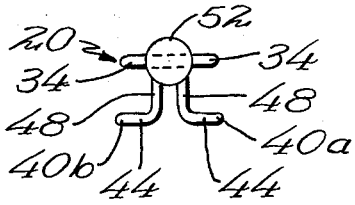
FIG. 7 is a front end view taken from the left in FIGS. 5 and 6.
Figure 9:
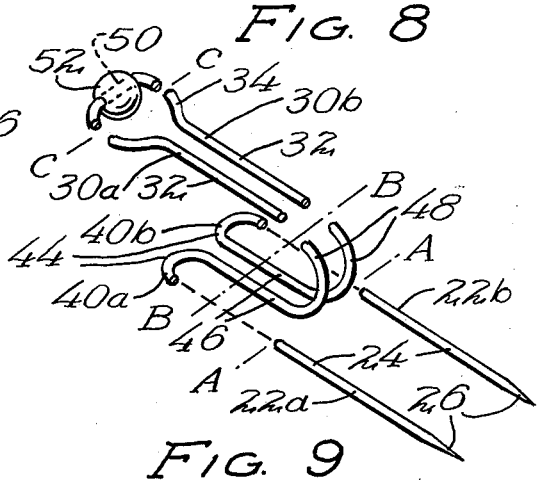
FIG. 9 is a perspective view of my shoulder strap guard, portions being separated at the lines A—A, B—B and C—C in order to more clearly illustrate the invention, which lines have also been added to FIG. 6 to show where the separations of FIG. 9 have been taken.

At this stage it should be explained that the purpose of FIG. 9 is to simplify the description as much as possible and at the same time render the claims easier to understand. Accordingly, the guard 20 comprises first or prong portions **22*a* and 22*b*, each having a straight shank section 24 extending rearwardly and terminating in a pointed free end 26. The first or prong portions 22***a* and 22*b*, as best appreciated from FIGS. 5 and 7, reside in one plane.

The guard 20 further includes second or tongue portions 30*a* and 30*b* residing in a second plane spaced above the plane of the portions 22*a* and 22*b*. As can perhaps best be seen in FIG. 5, but also in FIGS. 6 and 9, the portions 30*a*, 30*b* are substantially equal in length to the portions 22*a*, 22*b*. Each second portion 30*a*, 30*b* includes a forwardly extending shank section 32 and a diverging end section 34.

Third or intermediate connecting portions 40*a* and 40*b* maintain the portions 22*a*, 22*b* and 30*a*, 30*b* in their respective planes. In this regard, as most readily discerned in FIG. 9, each portion 40*a*, 40*b* includes a first arcuate section 44 curving inwardly from the end of the particular straight shank section 24 to which it is integrally connected. Each portion 40*a*, 40*b* also includes a second or straight shank section 46 extending rearwardly toward the pointed ends 26 on the straight shank sections 24. Integrally connected to the rearmost ends of the straight shank sections 46 are arcuate or third sections 48 which curve upwardly into the plane in which the second portions 30*a*, 30*b* reside. Thus, the third portions 40*a* and 40*b* are instrumental in maintaining a vertical spacing of the portions 30*a*, 30*b* with respect to the portions 22*a* and 22*b*.

With the thought still in mind of presenting a simple description of my guard 20, a transverse or fourth portion 50 has been shown which connects together the diverging end sections 34 of the second portions 30*a* and 30*b*. The fourth portion 50 has a bead 52 loosely threaded thereon.

Figure 2:
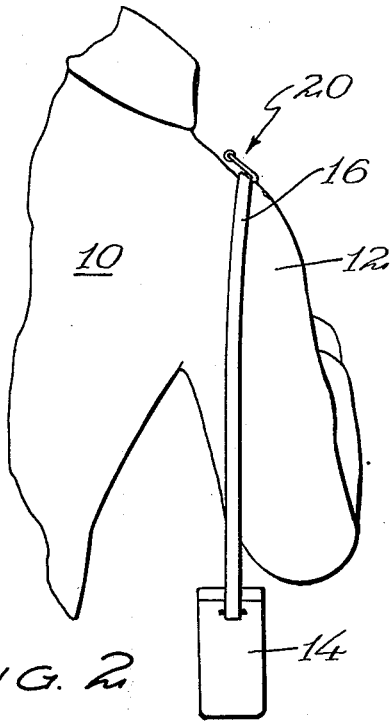
FIG. 2 is a view corresponding to FIG. 1, but depicting the shoulder strap after it has shifted sufficiently so as to be restrained by my guard.
Figure 3:
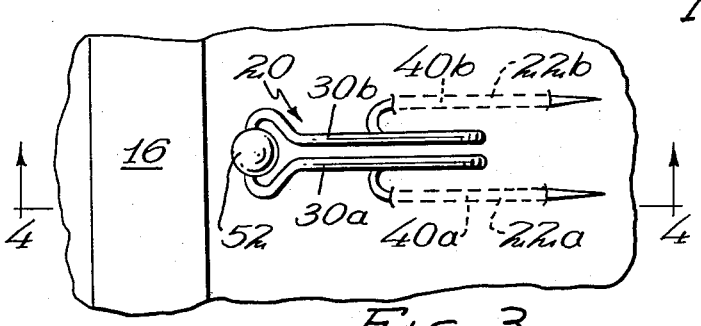
FIG. 3 is an enlarged top plan view of FIG. 1.

Owing to the maintenance of the second portions 30*a*, 30*b* in a raised plane with respect to the plane of the first portions 22*a*, 22*b*, a recess or gap 54 (see FIGS. 4 and 5) is formed for the accommodation or reception of the shoulder strap 16 when it has slipped or shifted sufficiently from the position in which it is pictured in FIG. 1 to the position in which it appears in FIG. 2. It should be recognized that FIG. 2 is somewhat exaggerated from normal in order to show a more pronounced sloping shoulder and an increased tendency for the strap 16 to slide downwardly; this rather severe sloping condition will transitionally occur, though, such as when a person leans over or sits down. It is when the strap 16 slides sufficiently downwardly, usually from the jostling experienced while walking, that it can slip completely from the person's shoulder, which can be quite annoying. However, my guard 20, as its name implies, acts as a restraining device so as to keep the strap 16 from moving so far that it falls from the shoulder portion 12 of the garment 10, the curved sections 48 of the portions 40*a*, 40*b* limiting such strap movement. Of course, if the wearer wishes to initially place the strap 16 in the gap 54, he or she can do so.

Figure 5:
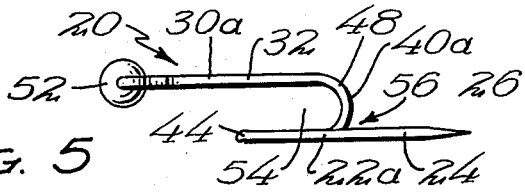
FIG. 5 is a side elevational view of the guard prior to being attached to the garment of FIGS. 1–4.
Figure 6:
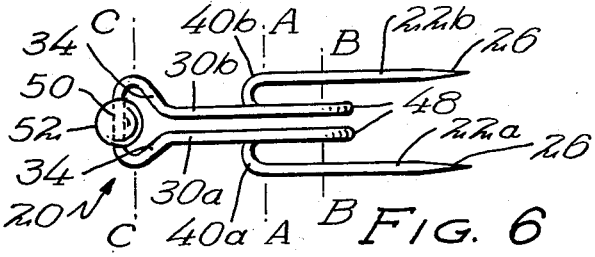
FIG. 6 is a top plan view of the guard as shown in FIG. 5.

At this time, attention is directed to what will be termed a notch 56 which appears when viewing FIG. 5; actually there are two such notches 56, one toward either side, for the curved sections 48 of the two portions 40*a*, 40*b* each form a notch with respect to the straight sections 24 of the portions 22*a*, 22*b*. These notches 56 enable the arcuate sections 48 of the portions 40*a*, 40*b* to be flexed upwardly when the pointed free ends 26 of the portions 22*a*, 22*b* are inserted far enough into the material constituting the shoulder region 12 of the outer garment 10. Although the inherent resiliency of the intermediate portions 40*a*, 40*b*, more specifically the straight shank sections 46 thereof, permit upward flexing when the prong portions 22*a*, 22*b* are inserted into the fabric, the spring action is such so as to cause the straight shank sections 46 to pressurally bear against the upper surface of the garment 10. This assists in firmly retaining the guard 20 at any desired location in the shoulder region 12, resisting any tendency for the guard to become detached when the shoulder strap 16 moves into the gap 54. The arcuate sections 48, by reason of their curvature, easily cam upwardly onto the upper surface of the fabric constituting the garment 10. Thus, the guard 20 can readily be attached with one hand and can equally well be detached or shifted to a new location whenever desired.

Figure 4:
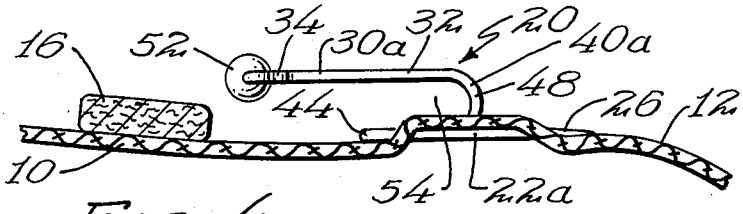
FIG. 4 is a sectional view taken in the direction of line 4—4 of FIG. 3.
Figure 8:
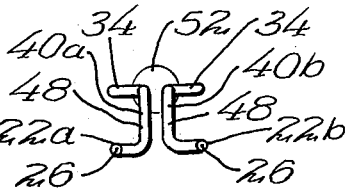
FIG. 8 is a rear end view taken from the right in FIGS. 5 and 6.

Whereas most shoulder straps will have a rectangular cross section, such as the section of the strap 16 as it appears in FIG. 4, it is recognized that some shoulder straps have a circular cross section. The gap 54, while it readily accommodates a rectangular strap 16, or a circular strap having a diameter corresponding to the thickness of the strap 16, nonetheless the gap 54 can be enlarged by simply flexing the portions 30*a* and 30*b* upwardly to permit the accommodation of a circular strap having virtually any diameter likely to be encountered.

Irrespective of the cross section of the shoulder strap to be received in the gap 54, the bead 52 gently resists the initial entrance of the strap into the gap 54, yet once the strap has entered the gap 54, it effectively resists any undue movement within the gap 54, this being particularly desirable should the user stoop over and perhaps tilt his or her shoulder to even a greater angle than that pictured in FIG. 2. Yet when the strap 16 is to be intentionally removed, the bead 52 offers very little resistance and permits the portions 30*a*, 30*b* to be readily flexed upwardly, if need be, in order to remove the strap 16 from the guard 20.

It has already been stated that FIG. 9 has been presented in order to simplify the description of the guard 20. In this regard, although in its preferred form the guard 20 is made from a single piece of wire, the breaks at lines A—A, B—B and C—C readily enable the portions 22*a*, 22*b*, 30*a*, 30*b*, 40*a*, 40*b* as well as the portion 50, to be referred to. The manner of describing the various portions should also provide a clearer antecendence as far as the claim terminology hereinafter presented is concerned.

I claim:

1. A wire shoulder strap guard comprising a first pair of laterally spaced portions including straight sections, said first portions residing in one plane and having free pointed ends for insertion into the shoulder region of a garment, a second pair of laterally spaced portions including straight sections, said second portions residing in a second plane above said one plane and the spacing of said second portions being less than that of said first portions, and a third pair of portions including arcuate first sections curving inwardly from the straight sections of said first portions and residing in substantially said one plane, straight second sections also substantially in said one plane and extending in the general direction of said pointed ends but terminating in a spaced relation with respect to said pointed ends and arcuate third sections curving upwardly from said second straight sections to the straight sections of said second portions to maintain said second portions in said second plane, whereby a shoulder strap can be received under said second portions when said first portions have been inserted into the garment.

2. A guard in accordance with claim 1 in which said first and second portions are generally equal in length to each other, said first portions projecting beyond said arcuate third sections and said second portions projecting beyond said arcuate first sections.

3. A guard in accordance with claim 2 including a transverse fourth portion connecting the straight sections of said second portions together at the ends thereof remote from said arcuate third sections.

4. A guard in accordance with claim 3 in which said second portions include diverging end sections adjacent said fourth portion joined to the ends of said fourth portion.

5. A guard in accordance with claim 4 including a bead member threadedly received on said fourth portion.

* * * * *